United States Patent [19]

Ishida et al.

[11] Patent Number: 4,876,876

[45] Date of Patent: Oct. 31, 1989

[54] DIES FOR FORGING GEAR-SHAPED PART MADE OF SHEET METAL

[75] Inventors: Kyoso Ishida, Hiroshima; Shinya Kodama, Aki, both of Japan

[73] Assignee: Mazda Motor Corporation, Hiroshima, Japan

[21] Appl. No.: 263,250

[22] Filed: Oct. 27, 1988

[30] Foreign Application Priority Data

Oct. 27, 1987 [JP] Japan ..... 62-269211
Nov. 10, 1987 [JP] Japan ..... 62-294509

[51] Int. Cl.[4] ..... B21D 22/26

[52] U.S. Cl. ..... 72/348; 72/335; 29/159.2

[58] Field of Search ..... 72/335, 336, 347, 348; 29/159 R, 159.2

[56] References Cited

U.S. PATENT DOCUMENTS 3,796,085 3/1974 Fisher et al. ..... 72/348
4,397,171 8/1983 Suh et al. ..... 72/348

FOREIGN PATENT DOCUMENTS 139432 8/1982 Japan ..... 72/347
59-42144 3/1984 Japan .
59-42147 3/1984 Japan .
61-238436 10/1986 Japan .
62-31770 2/1987 Japan .

*Primary Examiner*—Lowell A. Larson

*Attorney, Agent, or Firm*—Wenderoth, Lind & Ponack

[57] ABSTRACT

Disclosed herein in dies for forging a gear-shaped part made of a sheet metal, comprising a cylindrical die for forming, in cooperation with a cylindrical punch, tooth portions and bottom land portions at a peripheral wall portion of a cup-shaped work integrally formed from the sheet metal, wherein ridges and grooves provided at the inner peripheral surface of the cylindrical die in the axial direction of the die in order to form the tooth portions and the bottom land portions are such that, in the direction from an insertion-side opening of the cylindrical die toward the depth of the die, the height of the ridges is gradually increased to a final height, then the width of the ridges is gradually increased to a final width, and thereafter the depth of the grooves is gradually decreased to a final depth. The part is forged sequentially stepwise in the order of the bottom land portions, side surfaces of the teeth and the crests of the teeth, namely, from inner to outer side, so that no irrational forces are applied to the work. Therefore, die wear at the terminal ends of the tooth portions of the part can be restrained, and it is possible to secure an effective tooth length and to contrive a compact form of the part. At the same time, an enhanced yield can be contrived through prevention of cracking, and the useful lives of the punch, the die and the like can be prolonged because no irrational forces are applied to the tools.

9 Claims, 5 Drawing Sheets

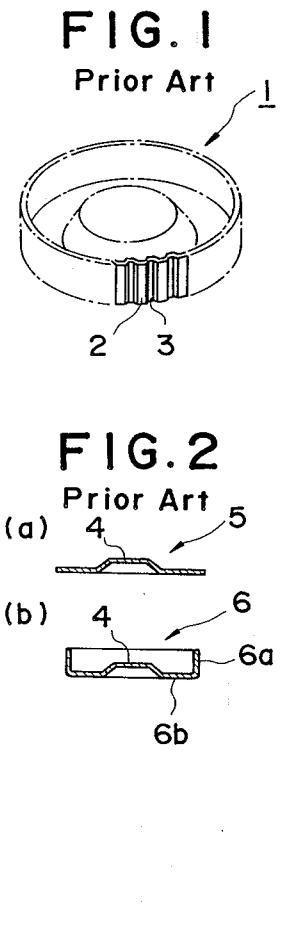
FIG. 1
Prior Art
1
2
3
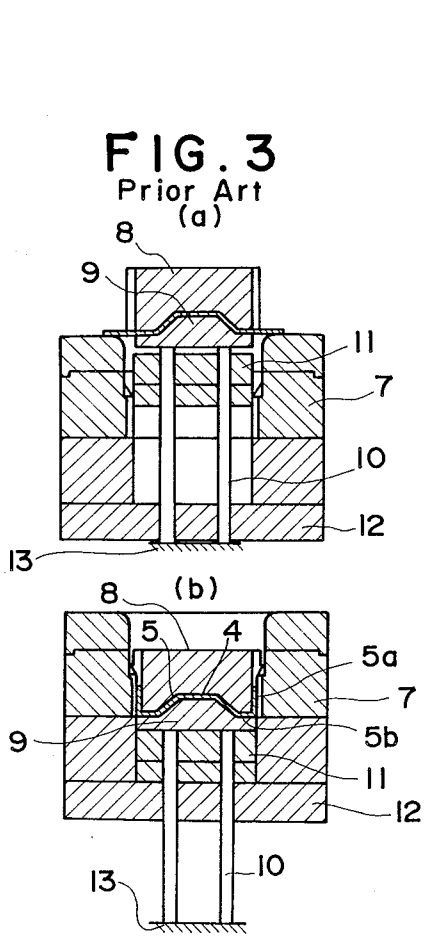
FIG. 2
Prior Art
(a)
(b)
4
5
6
6a
6b
FIG. 3
Prior Art
(a)
(b)
7
8
9
10
11
12
13
4
5
5a
5b
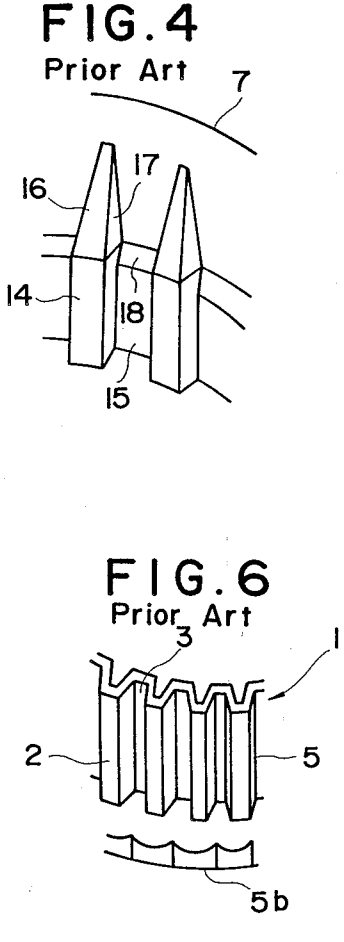
FIG. 4
Prior Art
7
14
15
16
17
18
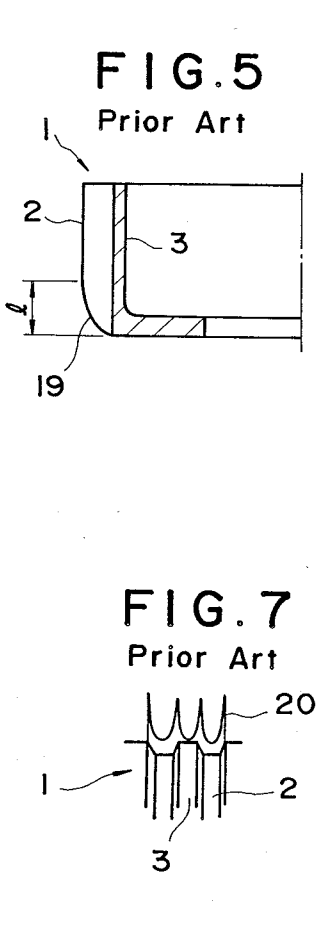
FIG. 5
Prior Art
1
2
3
19
FIG. 6
Prior Art
1
2
3
5
5b
FIG. 7
Prior Art
1
2
3
20

40
45
6a
46
6b
6
25
47
6f 40
45
41
42
46
6b
6
6c
6a
25
47
26
27

(a)
8
6
4
6a
6b
21
(b)
8
6
6b
6a
4
22

DIES FOR FORGING GEAR-SHAPED PART MADE OF SHEET METAL

BACKGROUND OF THE INVENTION (1) Field of the Invention

This invention relates to an improvement in forging dies used for manufacture of a gear-shaped part made of a sheet metal, such as a pulley for a toothed belt.

(2) Description of the Prior Art

Gear-shaped parts made of sheet metal are widely used as pulleys for use under relatively low loads, such as pulleys for toothed belts (See, for instance, Japanese Patent Application Laid-Open (KOKAI) No. 61-238436 (1986)).

In the manufacture of a gear-shaped part such as a gear and a pulley for a toothed belt (the gear-shaped part will be hereinafter referred to simply as "the part"), for instance, there has been generally known the so-called spline forming process in which a flat steel sheet blank is press formed into a cup shape having a cylindrical peripheral wall portion, and the peripheral wall portion of the cup-shaped article (hereinafter referred to as "the work") is squeezed into a splined shape (See, for instance, Japanese Patent Application Laid-Open (KOKAI) No. 59-42144 (1984)).

According to the spline forming process, it is possible to obtain a predetermined strength required of the part, by appropriately setting the material and plate thickness of the blank, conditions of forming, etc. It is also possible to realize a marked reduction in weight of the part, as compared to that in a conventional manufacturing process in which a blank roughly formed by casting, forging or the like is finished to the final shape by mechanical working or the like. Application of the spline forming process to mass-production of a product has a great practical merit of low manufacturing cost because of the use of press working, which is higher in productivity than the conventional manufacturing process.

Therefore, particularly in the case of an automobile engine, transmission or the like incorporating a multiplicity of parts therein, manufacture of the parts by the spline forming process enables a reduction in the total weight of the engine or transmission and in the manufacturing cost.

More particularly, as shown in FIG. 1, the part 1 comprises a shallow closed-end cylinder (so-called cup-shaped body) with tooth portions 2 and bottom land portions 3 integrally formed at the outer periphery of the peripheral wall portion of the cylinder. The part 1 is obtained by forging, by a die and a punch, either a work 5 obtained by forming a positioning mount surface 4 at a central portion of a circular disklike blanked material, as shown in FIG. 2(*a*), or a work 6 obtained by drawing a peripheral portion of the work 5 to give a cylindrical shape, as shown in FIG. 2(*b*). FIGS. 3(*a*) and 3(*b*) illustrate the process of manufacturing the part 1 from the work 5 by forging, in which the work 5 is drawn in a cylindrical die 7 by a cylindrical punch 8, whereby the peripheral portion of the work 5 is drawn to give a cylindrical shape and, simultaneously, the peripheral wall portion 5*a* is formed with tooth portions 2 and bottom land portions 3. In FIGS. 3(*a*) and 3(*b*), numeral 9 denotes a counter punch, 10 a cushion pin, 11 a support plate, 12 a base plate, and 13 denotes a cushion pad.

The inner peripheral surface of the die 7 is provided with ridges 14 and grooves 15 for forming the tooth portions 2 and the bottom land portions 3 of the part 1, as shown in FIG. 4. Namely, the peripheral wall portion 5*a* of the work 5 is pressed by the ridges 14 to form the bottom land portions 3, and the peripheral wall portion 5*a* of the work 5 is forced into the grooves 15 to form the tooth portions 2.

According to, for instance, Japanese Patent Application Laid-Open (KOKAI) No. 59-42147 (1984), the shapes of the ridges 14 and the grooves 15 of the conventional die 7 have been as shown in FIG. 4. Therefore, the depths of the bottom land portions 3 are formed by taper surfaces 16 of the ridges 14, while the gaps between the tooth portions 2, or the side surfaces of the tooth portions 2, are formed by taper surfaces 17 of the ridges 14. Then, the heights of the tooth portions 2, or the crests of the tooth portions 2 are formed by taper surfaces 18 of the grooves 15. Thus, with the conventional die 7, the bottom land portions 3 and the side surfaces of the tooth portions 2 have been formed at a stroke, so that excessive tensile forces have been applied between the bottom wall portion 5*b* and the peripheral wall portion 5*a* of the work 5. Due to the excessive tensile forces, a rounded portion called die wear 19 might be generated at one end of the tooth portion 2 of the part 1, leading a reduction of the effective tooth length by l, as shown in FIG. 5. Or, particularly where the tooth height is set to be relatively large, as shown in FIG. 6, cracking might occur between the bottom wall portion 5*b* and the peripheral wall portion 5*a* of the work 5. FIG. 7 shows burrs 20 which are generated at an opening-side end portion of the peripheral wall portion 5*a* of the work 5.

To overcome the drawbacks of the die wear 19 and the like, there has been proposed a forging process as shown in FIGS. 8(*a*) and 8(*b*) (See Japanese Patent Application Laid-Open (KOKAI) No. 62-31770 (1987)). The forging process comprises a first step in which, as shown in FIG. 8(*a*), a work 6 preformed with a peripheral wall portion 6*a* is pushed into a first die 21, starting with a bottom wall portion 6*b* thereof, and then taken out of the first die 21. In a second step, as shown in FIG. 8(*b*), the work is pushed into a second die 22, starting with the opposite end thereof. According to the process, the peripheral wall portion 6*a* is squeezed in the opposite directions, so that the length of die wear is reduced. The forging process, however, is disadvantageous on a production efficiency basis, because the process is divided into the two steps and reversion of the work 6 and application of a lubricant to the surface of the work 6 must be performed two times each. In addition, the process has also a problem as to equipment cost due to the need to prepare two kinds of dies and punches.

SUMMARY OF THE INVENTION

This invention has been attained so as to overcome all the above-mentioned problems, and it is an object of the invention to provide dies for forging a gear-shaped part made of sheet metal by which the part can be forged in a single step without causing die wear or cracking.

This invention resides in dies for forging a gear-shaped part made of a sheet metal, comprising a cylindrical die for forming, in cooperation with a cylindrical punch, tooth portions and bottom land portions at a peripheral wall portion of a cup-shaped work integrally formed from the sheet metal, wherein ridges and grooves provided at the inner peripheral surface of the cylindrical die in the axial direction of the die in order to form the tooth portions and the bottom land portions are such that, in the direction from an insertion-side opening of the cylindrical die toward the depth of the die, the height of the ridges is gradually increased to a final height, then the width of the ridges is gradually increased to a final width, and thereafter the depth of the grooves is gradually decreased to a final depth.

With the above-mentioned construction, the part is forged sequentially stepwise in the order of the bottom land portions, side surfaces of the teeth and the crests of the teeth, namely, from inner to outer side, so that no irrational forces are applied to the work. Therefore, die wear at the terminal ends of the tooth portions of the part can be restrained, and it is possible to secure an effective tooth length and to contrive a compact form of the part. At the same time, with the dies, an enhanced yield can be contrived through prevention of cracking, and the useful lives of the punch, the die and the like can be prolonged because no irrational forces are applied to the tools.

In this invention, the ridges may be provided with three taper surface portions for gradually increasing the height of the ridges and with rectilinear portions connecting the taper surface portions, in the range from the insertion-side opening of the cylindrical die to the position of the final worked height. The grooves may be provided with one taper surface for decreasing the depth of the grooves. The punch may be provided with a stepped portion for defining a gap in a fitting direction between the stepped portion and a peripheral wall end portion of the cup-shaped work in the unworked state, at an end portion of each of the ridges of the punch to be fitted to a peripheral wall portion of the work. The height of the stepped portion of the punch is set to be smaller than the plate thickness of the work so that the stepped portion will not protrude outward beyond the peripheral wall portion of the work. The cup-shaped work may have a substantially circular hole portion in a bottom surface portion thereof, and at least one of the punch and the cylindrical die may comprise a material flow control means for controlling the radially inward flow of the work material in the vicinity of the hole portion. The material flow control means may comprise a recessed portion and a projected portion possessed by the punch and the cylindrical die, respectively. The material flow control means may comprise a projected portion possessed by one of the punch and the cylindrical die, the projected portion being inserted into the hole portion of the work. Further, the projected portion is made to have such an outside diameter as to define a gap in the radial direction between the projected portion and the peripheral edge of the hole portion of the work in the unworked state.

The above and other object, features and advantages of this invention will become apparent from the following description and appended claims, taken in conjunction with the accompanying drawings which show by way of example some preferred embodiments of the invention.

BRIEF DESCRIPTION OF THE DRAWINGS

FIGS. 1 to 8 illustrate examples of the prior art, in which:

FIG. 1 shows a perspective view of a gear-shaped part;

FIGS. 2(*a*) and 2(*b*) each shows a vertical sectional view of a work for producing the gear-shaped part therefrom;

FIGS. 3(*a*) and 3(*b*) each shows a vertical sectional view of die and punch;

FIG. 4 shows a perspective view of the inner peripheral surface of the die;

FIG. 5 shows a sectional view of the terminal end of a tooth portion of the gear-shaped part;

FIG. 6 shows a side perspective view of the gear-shaped part having cracks therein;

FIG. 7 shows a partial perspective view of the opening end of the gear-shaped part on which the burrs are generated; and FIGS. 8(*a*) and 8(*b*) each shows a side view of die and punch according to another example of the prior art, in a split state.

FIGS. 9 to 11 are a series of sectional illustrations of the work and the pressing apparatus, for explaining this invention.

FIGS. 13 to 20 show embodiments of this invention, in which:

FIG. 13 shows a vertical sectional view of a die;

FIGS. 14(*a*) to 14(*c*) each shows a vertical sectional view of the ridge of the die;

FIG. 15 shows a sectional view of the lower end of the punch;

FIGS. 16(*a*) to 16(*c*) each shows a sectional view of a tooth portion of the gear-shaped part;

FIG. 17 shows a sectional view of the terminal end of the tooth portion of the gear-shaped part;

FIG. 18 shows a partially enlarged sectional illustration of the work and the pressing apparatus, for explaining the deformation of a corner portion of the work;

FIG. 19 shows a vertical sectional view of an improved work and the pressing apparatus, illustrating a bottom surface portion of the work in an enlarged form; and FIG. 20 shows a vertical sectional view of another improved work and the pressing apparatus.

DESCRIPTION OF THE PREFERRED EMBODIMENTS

Figures 8, 9, 10:
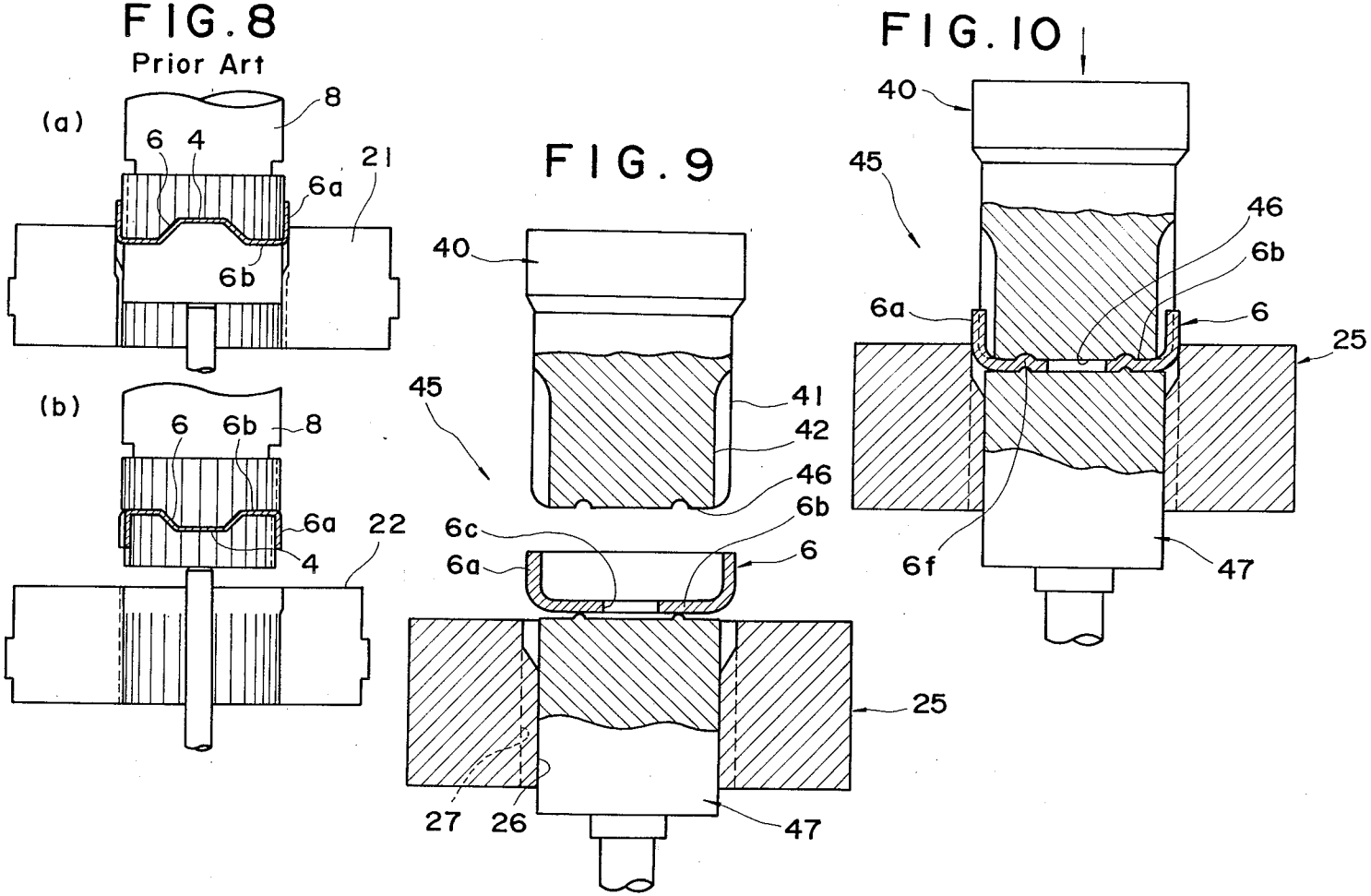
FIG. 8 Prior Art

An embodiment of this invention will now be described below referring to the drawings.

A sheet metal-made gear as the part according to this embodiment of the invention is obtained by drawing a blank obtained by blanking from a flat steel plate blank material, to form a cup-shaped work 6 having a cylindrical peripheral wall portion 6*a* as shown in FIGS. 9 and 10, and providing the peripheral wall portion of the work 6 with spline teeth by squeezing.

A bottom wall portion 6*b* of the work 6 is provided with a hole portion 6*c* for fitting a rotary shaft (not shown) after finishing the work 6 into a gear. The hole portion 6*c* is preferably formed at the same time with the blanking from the steel plate blank material.

The squeezing step and a pressing apparatus used for the squeezing will now be explained below.

Figure 11:
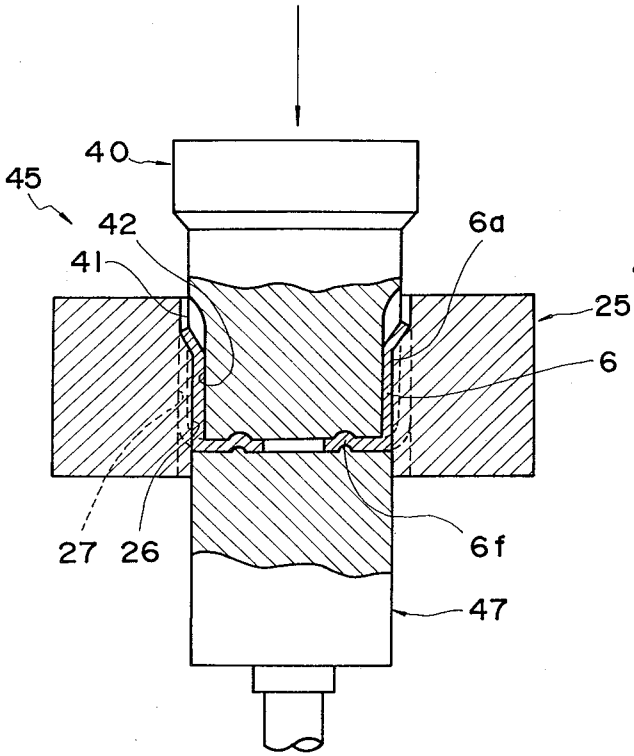

As shown in FIGS. 9, 10 and 11, the pressing apparatus 45 for providing the peripheral wall portion 6*a* of the work 6 with spline teeth by squeezing comprises a die 25 which is provided at its inner peripheral portion with grooves 27 and ridges 26 corresponding to the outer surface profile of the spline teeth and is fixed to the pressing apparatus 45, a punch 40 which is provided at its outer peripheral portion with ridges 41 and grooves 42 corresponding to the inner surface profile of the spline teeth and is vertically movable relative to the die 25, and a die cushion 47 which is vertically movable relative to the die 25 in engagement with the inner peripheral portion of the die 25 and is opposed to a lower end portion 46 of the punch 40.

A setting is provided such that, when the punch 40 is lowered to be fitted to the inner peripheral portion of the die 25, the gap defined between the grooves 27 and the ridges 26 provided at the inner peripheral portion of the die 25 and the ridges 41 and the grooves 42 provided at the outer peripheral portion of the punch 40 is appropriately smaller than the material thickness of the peripheral wall portion 6a of the work 6.

With the pressing apparatus 45 having the above-mentioned construction, the peripheral wall portion 6a of the work 6 is provided with spline teeth by squeezing, as follows. First, as shown in FIG. 9, the work 6 is mounted on the die cushion 47 of the pressing apparatus 45, with the peripheral wall portion 6a directed upward. At this time, the die cushion 47 is located at a raised position, so that the bottom wall portion 6b of the work 6 is located above the upper surface of the die 25.

Next, in this condition, the punch 40 is lowered until a lower end portion 46 thereof makes contact with the bottom wall portion 6b of the work 6 and presses the bottom wall portion 6b downward, as shown in FIG. 10, while a cushion pressure is exerted on the die cushion 47 by a pneumatic or hydraulic pressure or the like to support the work 6. The work 6 now has the bottom wall portion 6b clamped between the punch 40 and the die cushion 47, whereby the work 6 is fixed.

With the work 6 fixed as mentioned above, the punch 40 is lowered, whereby as shown in FIG. 11, the peripheral wall portion 6a of the work 6 is pressed into the gap defined between the grooves 27 and the ridges 26 provided at the inner peripheral portion of the die 25 and the ridges 41 and the grooves 42 provided at the outer peripheral portion of the punch 40, and is deformed with a flow of material in the squeezing direction, whereby the peripheral wall portion 6a is provided with spline teeth of predetermined shape.

Figure 12:
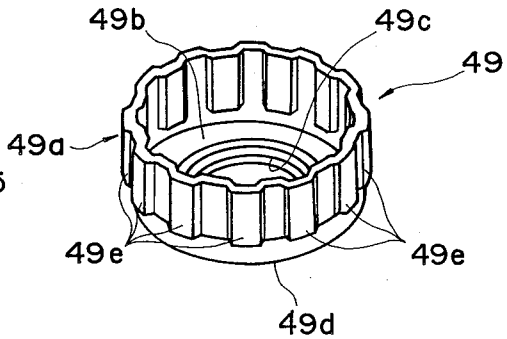
FIG. 12 shows an overall perspective view of a gear as the part according to this invention.

By the series of squeezing step, as shown in FIG. 12, a gear 49 is obtained which has a peripheral wall portion 49a provided with predetermined spline teeth 49e and has a bottom wall portion 49b provided with a hole portion 49c for fitting a rotary shaft (not shown).

Figure 13:
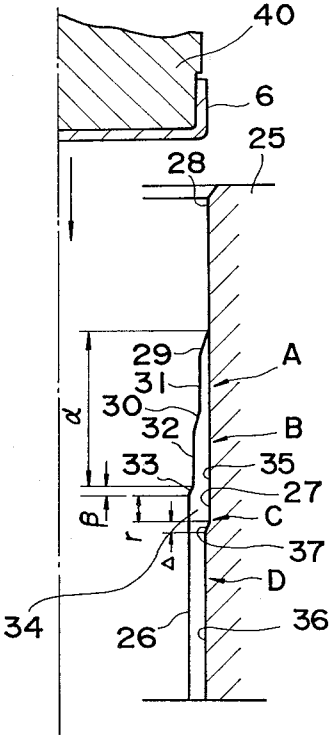

FIG. 13 shows a vertical sectional view of the inner peripheral wall of the die 25. As shown in the figure, the inner peripheral surface of the die 25 is provided with the ridges 26 and the grooves 27, alternately and contiguously, in the axial direction thereof. The ridges 26 and the grooves 27 serve to form tooth portions 2 and bottom land portions 3 of the part 1.

Basically, the ridges 26 and the grooves 27 provided at the inner peripheral surface of the die 25 in the axial direction of the die in order to form the tooth portions 2 and the bottom land portions 3 are such that, in the direction from an insertion-side opening 28 of the die 25 toward the depth of the die 25, the height of the ridges 26 is gradually increased to a final height, then the width of the ridges 26 is gradually increased to a final width, and thereafter the depth of the grooves 27 is gradually decreased to a final depth. The ridges 26 are provided with three taper surface portions 29, 30 and 33 at least, for gradually increasing the height of the ridges 26 and with rectilinear portions 31 and 32 connecting the three taper surface portions 29, 30 and 33, in the range from the insertion-side opening 28 to the position of the final worked height.

Specifically, the ridge 26 starts to rise at a point slightly to the deeper side from the insertion-side opening 28 of the die 25, and extends to the depth of the die 25 while becoming gradually higher. More specifically, the ridge 26 has a portion $\alpha$ ranging from the rising point to a substantially central portion thereof, then has relatively short portions $\beta$ and $\gamma$ in succession, and the following portion has a substantially constant cross-sectional shape. The portion $\alpha$ is, so to speak, for preforming, and has taper surfaces 29 and 30 on a height direction basis at the rising portion and an intermediate portion, with the portions before and after the intermediate taper surface 30 constituting the rectilinear portions 31 and 32 each having a substantially fixed height. It is preferable that the taper surface 29 at the rising portion is not conical in shape, for obtaining a good drawing effect. The sectional shape of the portion $\alpha$, in terms of section A of the rectilinear portion 31 is as indicated by the solid line in FIG. 14(a), namely, a relatively moderate wavy shape. On the other hand, the shape of section B of the rectilinear portion 32 is as indicated by the chain line in FIG. 14(a), namely, the height of the ridge 26 is somewhat greater.

Next, the portion $\beta$ is for forming the bottom land portion 3 of the part 1, and consists of the taper surface 33 for pressing the peripheral wall portion 6a of the work 6 to the final depth.

Figure 14:
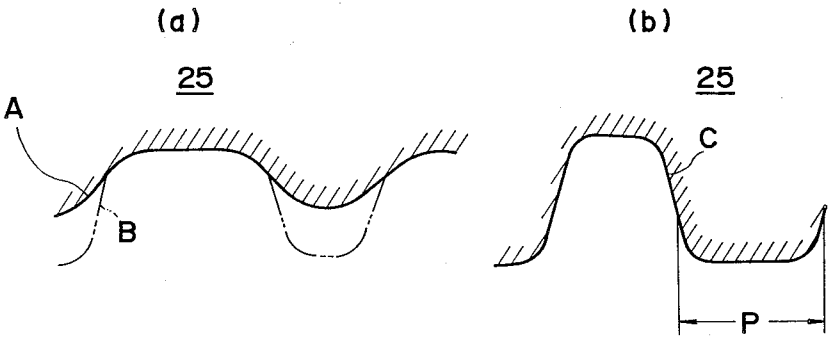

The portion $\gamma$ is for forming the side surfaces of the tooth portion 2 of the part 1, and consists of a taper surface 34 having a substantially constant height and a gradually increasing width. The final sectional shape of the portion $\gamma$, in terms of section C, is as shown in FIG. 14(b), in which the width P of the ridge 26 determines the final spacing between the tooth portions 2. Thereafter, the ridge 26 extends to the depth of the die 25 with the height and width of the ridge 26 remaining constant.

The grooves 27 are each formed between the ridges 26. The portion of the groove 27 corresponding to the portions $\alpha$, $\beta$ and $\gamma$ is a rectilinear portion 35, which is followed by a portion $\Delta$ and then, again, by a rectilinear portion 36. The groove 27 is provided with a taper surface portion 37 for decreasing the depth of the groove 27. The portion $\Delta$ is for forming the crest of the tooth portion 2 of the part 1, and consists of the taper surface 37 for pressing the peripheral wall portion 6a of the work 6 to the final height of the tooth portion 2. The final sectional shape of the portion $\Delta$, in terms of section D, is as shown in FIG. 14(c), in which the depth H of the groove 27 determines the final height of the tooth portion 2.

Figure 15:
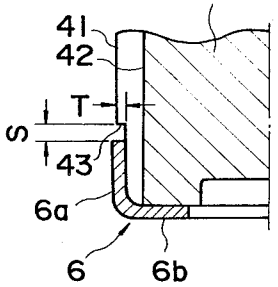

The shape of the punch 40 will now be explained based on FIG. 15. The punch 40 is cylindrical, and the peripheral surface thereof is provided with the ridges 41 and the grooves 42 corresponding to the tooth portions 2 and the bottom land portions 3 of the part 1. The ridges 41 of the punch 40 are fitted to the grooves 27 of the die 25, and the ridges 26 of the die 25 to the grooves 42 of the punch 40, with the peripheral wall portion 6a of the work 6 clamped therebetween, whereby the peripheral surface shape of the part 1 is defined. The punch 40 is provided with a stepped portion 43 for defining a gap S in the fitting direction between the stepped portion 43 and an end portion of the peripheral wall portion 6a of the cup-shaped work 6 in the unworked state, at an end portion of each of the ridges 41 fitted to the peripheral wall portion 6a of the work 6. Specifically, the stepped portion 43 is provided at the end portion of each ridge 41 to be fitted to the peripheral wall portion 6a of the work 6, so that a slight gap S is defined between the stepped portion 43 and the work 6 when the work 6 is set in position. The height of the stepped portion 43 of the punch 40 set to be smaller than the plate thickness of the work 6 so as not to protrude outward beyond the peripheral wall portion 6a of the work 6. Namely, the height T of the stepped portion 43 is set to be slightly smaller than the plate thickness t of the work 6, preferably $0.05\ t \leqq T \leqq 0.5\ t$, in order to obviate full enclosed die forging. With such stepped portions 43 provided, it is possible to restrain the generation of the burrs 20. When full enclosed die forging occurs, the load on the punch 40 is so high that seizure to the die 25 may take place.

Figure 16:
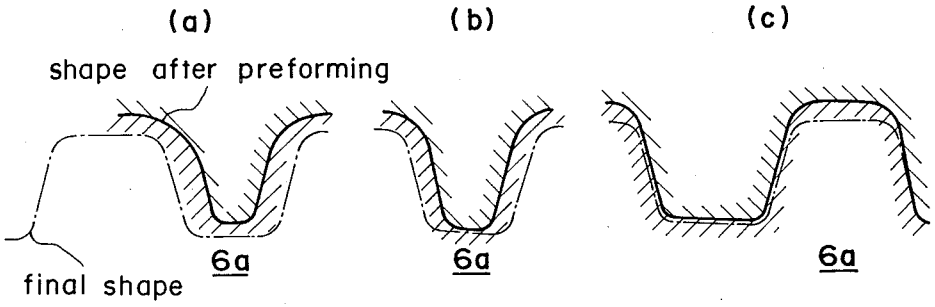

The die 25 and the punch 40 for forging the part 1 are constructed as mentioned above. When the work 6 coated with a lubricant is fitted to the punch 40 and pressed into the die 25, as shown in FIG. 13, the peripheral wall portion 6a of the work 6 is first preformed by being pressed by the portions $\alpha$ of the ridges 26 of the die 25, as indicated by the solid line in FIG. 16(a). Then, the peripheral wall portion 6a is pressed by the portions $\beta$ of the ridges 26, whereby the final depth of the bottom land portions 3 is determined. Thereafter, the side surfaces of the tooth portions 2 are pressed by the portions $\gamma$ of the ridges 26, whereby the final shape of the side surfaces of the tooth portions 2 is determined. Finally, tip surfaces of the tooth portions 2 are pressed by the portions $\Delta$, whereby the final shape of the crests of the tooth portions 2 is determined.

Figure 17:
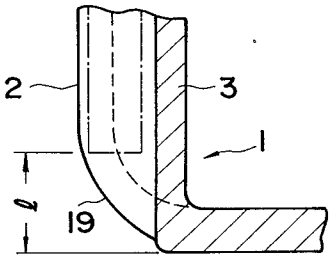

As has been explained above, the peripheral surface profile of the part 1 is formed sequentially stepwise from inner to outer side, so that no irrational forces are exerted on the work 6, the die 25 or the like. Therefore, it is possible to set the length l of the die wear 19 generated in the part 1 to be extremely short, as shown in FIG. 17. As a result, it is possible to secure an effective tooth length and to achieve a thin compact form of the part 1, and it is possible to contrive a longer useful life of the die 25 and the like.

In forming the gear-shaped part by the spline forming process, an excessive flow of material in the squeezing direction may occur at a corner portion at which the peripheral wall portion of the work to be provided with the spline teeth and the bottom wall portion join, causing a reduction of the material thickness below a predetermined value, resulting in an insufficient strength at that portion.

To cope with this problem, a stopper portion may be provided at an outer peripheral portion of the punch combined with the die to perform squeezing, whereby it is possible to restrain the excessive flow of material in the squeezing direction, by the stopper portion, thereby preventing the reduction in the material thickness at the corner portion.

In many cases of the gear-shaped part, the work is provided with a hole portion in the bottom wall portion thereof so as to achieve a further reduction in the weight of the part or to fit a rotary shaft for rotating the part. Particularly where the hole portion for fitting the rotary shaft is provided, it is necessary to maintain a predetermined dimensional accuracy as to the hole diameter, the hole portion is usually finished again by mechanical working or the like after the squeezing.

Figure 18:
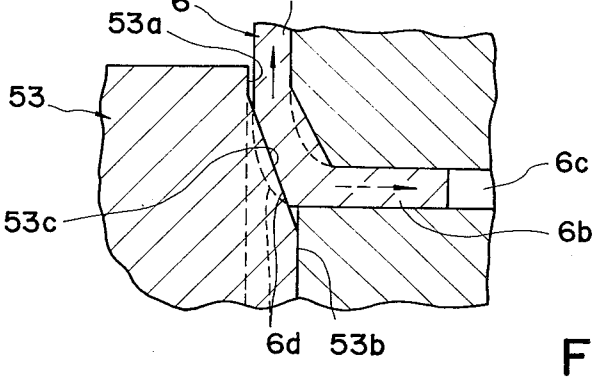

However, where the gear-shaped part is formed by the spline forming process, as for instance shown in FIG. 18, the corner portion 6d connecting between the peripheral wall portion 6a and the bottom wall portion 6b of the work 6 is first deformed by being pressed by a slant surface portion 53c connecting smoothly a ridge portion 53b and a cylindrical portion 53a of the die 53. Therefore, the flow of the plate material takes place not only in the squeezing direction indicated by the solid-line arrow in FIG. 18 but in the radial direction indicated by the broken-line arrow in the figure. Particularly where the hole portion 6c is provided in the bottom wall portion 6b of the work 6, the flow of material in the radial direction takes place freely, causing a marked reduction in the material thickness at the corner portion 6d connecting between the peripheral wall portion 6a to be provided with the spline teeth and the bottom wall portion 6b. As a result, the material thickness at the corner portion 6d is reduced to below a predetermined value, and the strength of this portion becomes insufficient. It is thus necessary to prevent the reduction, to below a predetermined value, of the material thickness at the corner portion 6d connecting between the peripheral wall portion 6a provided with the spline teeth by squeezing and the bottom wall portion 6b.

In consideration of the above, according to this invention, at least one of the punch 40 and the die 25 is provided with a material flow control means 48 for controlling the radially inward flow of work material in the vicinity of the hole portion 6c at the time of providing, by squeezing, the spline teeth at the peripheral wall portion 6a of the cup-shaped work 6 formed with the cylindrical peripheral wall portion 6a from a flat plate blank material.

The material flow control means 48 may comprise a recessed portion and a projected portion possessed by the punch 40 and the die 25, respectively. Also, the material flow control means 48 may comprise a projected portion possessed by either one of the die 25 and the punch 40, the projected portion being inserted into the hole portion 6c of the work 6. Especially, the projected portion is made to have such an outside diameter as to define a radial gap between the projected portion and the peripheral edge of the hole portion 6c of the work 6 in the unworked state.

Thus, squeezing for providing the peripheral wall portion 6a of the work 6 with the spline teeth is carried out by providing the material flow control means 48 for controlling the radial flow of the plate material in the bottom wall portion 6b of the work 6, whereby it is possible to prevent the reduction, to below a predetermined value, of the material thickness at the corner portion 6d connecting between the peripheral wall portion 6a provided with the spline teeth and the bottom wall portion 6b, and to maintain a strength required of that portion.

Where the hole portion 6c is provided in the bottom wall portion 6b of the work 6, the material flow control means 48 controls the radial flow of plate material in the bottom wall portion 6b, so that it is possible to maintain the inside diameter of the hole portion 6c at a predetermined accuracy at the time of squeezing. Therefore, where a predetermined dimensional accuracy is required as to the inside diameter of the hole portion 6c, as in the case where a rotary shaft is to be fitted to the hole portion 6c, it is possible to eliminate the need for the conventional step of finishing the hole portion 6c by mechanical working or the like after the squeezing, and it is possible to reduce the manufacturing cost.

A concrete explanation of the above will be given below. In forming a gear 49 as the part according to this embodiment of the invention, squeezing is carried out by providing the material flow control means 48 for controlling the radial flow of plate material in the bottom wall portion 6b of the work 6, in order that the material thickness at the corner portion 49d connecting between the peripheral wall portion 49a and the bottom wall portion 49b is prevented from being reduced to below a predetermined value due to the squeezing.

Figure 19:
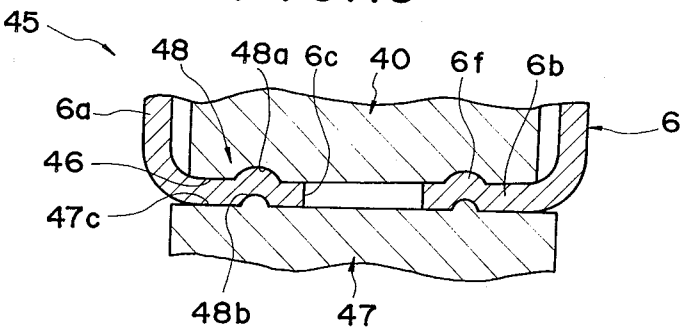

Namely, as shown in FIG. 19 in terms of enlarged section, an upper end portion 47c of the die cushion 47 of the pressing apparatus 45 according to this embodiment is provided with an annular projected portion 48b having a substantially semicircular outer peripheral shape in section, at a position corresponding to the vicinity of the inner peripheral portion of the hole portion 6c of the work 6. On the other hand, an annular groove portion 48a having a semicircular outer peripheral shape in section, corresponding to the projected portion 48b, is provided on a lower end portion 46 of the punch 40 opposed to the die cushion 47 at a position corresponding to the projected portion 48b.

A cushion pressure is applied to the die cushion 47 to support the work 6 by the die cushion 47, and the punch 40 is lowered to press the bottom wall portion 6b of the work 6 (See FIG. 10), whereby it is possible to provide the bottom wall portion 6b with an annular engaging portion 6f for engagement with the groove portion 48a and the projected portion 48b, prior to squeezing the peripheral wall portion 6a of the work 6.

Accordingly, at the time of squeezing the peripheral wall portion 6a of the work 6, the bottom wall portion 6b is clamped between the punch 40 and the die cushion 47 and pressed from above and from below, whereby the engaging portion 6f is fixed by being clamped between the groove portion 48a of the punch 40 and the projected portion 48b of the die cushion 47. As a result, it is possible to restrain the radial flow of plate material in the bottom wall portion 6b of the work 6.

As has been explained above, in order to control the radial flow of plate material in the bottom wall portion 6b of the work 6 at the time of providing the peripheral wall portion 6a of the work 6 with the spline teeth 49e by squeezing, the material flow control means 48 comprising the groove portion 48a of the punch 40 and the projected portion 48b of the die cushion 47 is provided, then the bottom wall portion 6b is provided with the engaging portion 6f by the material flow control means 48, and squeezing is carried out in the condition where the engaging portion 6f is fixed by the material flow control means 48. By this measure, it is possible to prevent the reduction, to below a predetermined value, of the material thickness at the corner portion 49d connecting between the peripheral wall portion 49a provided with the spline teeth 49e and the bottom wall portion 49b of the gear 49, and it is possible to maintain a strength required of the corner portion.

According to this embodiment, when the hole portion 49c is provided in the bottom wall portion 49b of the gear 49, the radial flow of plate material in the bottom wall portion 49b is controlled by the material flow control means 48, so that it is possible to maintain the inside diameter of the hole portion 6c of the work 6 with a predetermined accuracy at the time of squeezing. Therefore, where a predetermined dimensional accuracy is required as to the inside diameter of the hole portion 49c, as in the case where a rotary shaft (not shown) is to be fitted to the hole portion 49c, it is possible to eliminate the need for the conventional step of finishing the hole portion 49c by mechanical working or the like after the squeezing.

In the embodiment described above, the material flow control means 48 comprising the groove portion 48a of the punch 40 and the projected portion 48b of the die cushion 47 is provided for controlling the radial flow of the plate material in the bottom wall portion 6b of the work 6. As an alternative to this measure, the punch or the die cushion may be provided with a material flow control means to be fitted to the inner peripheral portion of the hole portion of the work, whereby it is possible to prevent the reduction, to below a predetermined value, of the material thickness at the corner portion connecting between the peripheral wall portion and the bottom surface portion of the gear.

Figure 20:
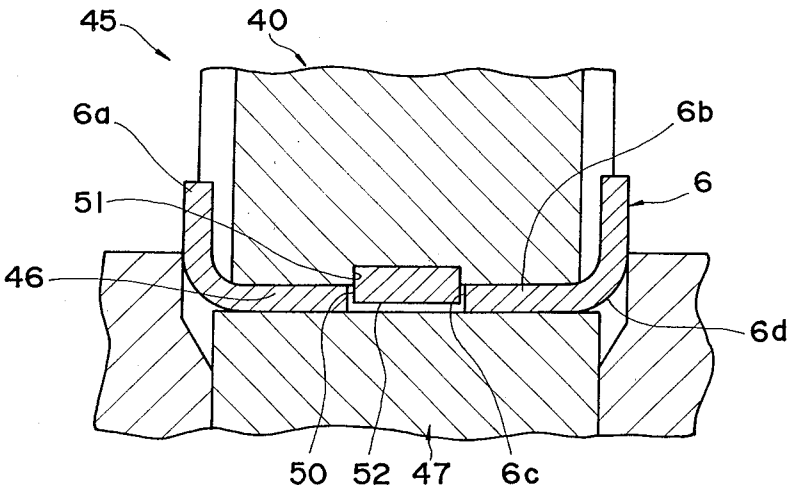

In the pressing apparatus 45 shown in FIG. 20, it is preferable that a stepped portion 50 having an outside diameter slightly smaller than the inside diameter of the hole portion 6c of the bottom wall portion 6b of the work 6 is provided at a central portion of a lower end portion 46 of the punch 40, the height of the stepped portion 50 being set to be smaller than the thickness of the bottom wall portion 6b of the work 6. The stepped portion 50 is provided by firmly fitting a circular disk-like member 52 having a predetermined thickness into a fitting hole portion 51 provided in the lower end portion 46 of the punch 40. The stepped portion may be formed as one body with the punch 40, without using the disklike member 52 separate from the punch 40.

A cushion pressure is exerted on the die cushion 47 to support the work 6 by the die cushion 47, and the punch 40 is lowered, whereby the stepped portion 50 is contained into the hole portion 6c of the work 6.

Therefore, when the peripheral wall portion 6a of the work 6 is provided with the spline teeth by squeezing, the inside diameter of the hole portion 6c in the bottom wall portion 6b of the work 6 will not be reduced below the outside diameter of the stepped portion 50 of the punch 40. Namely, the radial flow of plate material in the bottom wall portion 6b of the work 6 is restrained by the stepped portion 50.

Accordingly, by appropriately setting the gap between the inside diameter of the hole portion 6c of the work 6 and the outside diameter of the stepped portion 50 and the degree of concentricity of the two diameter portions, it is possible to prevent the reduction, to below a predetermined value, of the material thickness of the corner portion 6d connecting between the peripheral wall portion 6a and the bottom wall portion 6b of the work 6. In addition, through maintaining a predetermined dimensional accuracy as to the outside diameter of the stepped portion 50, it is possible to maintain the inside diameter of the hole portion 6c after squeezing to a predetermined dimensional accuracy. Thus, the same effect as above is obtainable.

While embodiments of this invention have been explained above, the invention is not limited to the above embodiments, and it is possible to make various modifications. For instance, this invention is applicable also to the case where the peripheral wall portion 6a of the work 6 is provided on the inner peripheral surface thereof with tooth portions and bottom land portions to be engaged with a pinion or the like. Besides, though the portions $\alpha$, $\beta$ and $\gamma$ of each ridge 26 and the portion $\Delta$ of each groove are formed stepwise and continuously in the above embodiments, the portions may be spaced from each other according to the shape of the desired product, and the portions may be made to partially overlap with each other in such a range as not to affect the product.

We claim:

1. Dies for forging a gear-shaped part made of a sheet metal, comprising a cylindrical die for forming, in cooperation with a cylindrical punch, tooth portions and bottom land portions at a peripheral wall portion of a cup-shaped work integrally formed from the sheet metal, wherein ridges and grooves provided at the inner peripheral surface of the cylindrical die in the axial direction of the die in order to form the tooth portions and the bottom land portions are such that, in the direction from an insertion-side opening of the cylindrical die toward the depth of the die, the height of the ridges is gradually increased to a final height, then the width of the ridges is gradually increased to a final width, and thereafter the depth of the grooves is gradually decreased to a final depth.

2. Dies for forging a gear-shaped part made of a sheet metal according to claim 1, wherein the ridges are provided with three taper surface portions at least, for gradually increasing the height of the ridges and with rectilinear portions connecting the taper surfaces portions, in the range from the insertion-side opening of the cylindrical die to the position of the final worked height.

3. Dies for forging a gear-shaped part made of a sheet metal according to claim 1, wherein the grooves are provided with one taper surface portion for decreasing the depth of the grooves respectively.

4. Dies for forging a gear-shaped part made of a sheet metal according to claim 1, wherein the punch is provided with a stepped portion for defining a gap in a fitting direction between the stepped portion and a peripheral wall end portion of the cup-shaped work in the unworked state, at an end portion of each of the ridges of the punch to be fitted to a peripheral wall portion of the work.

5. Dies for forging a gear-shaped part made of a sheet metal according to claim 4, wherein the height of the stepped portion of the punch is set to be smaller than the plate thickness of the work so that the stepped portion will not protrude outward beyond the peripheral wall portion of the work.

6. Dies for forging a gear-shaped part made of a sheet metal according to claim 1, wherein the cup-shaped work has a substantially circular hole portion in a bottom surface portion thereof, and at least one of the punch and the cylindrical die is provided with material flow control means for controlling a radially inward flow of the work material in the vicinity of the hole portion.

7. Dies for forging a gear-shaped part made of a sheet metal according to claim 6, wherein the material flow control means comprises a recessed portion and a projected portion possessed by the punch and the cylindrical die, respectively.

8. Dies for forging a gear-shaped part made of a sheet metal according to claim 6, wherein the material flow control means comprises a projected portion possessed by one of the punch and the cylindrical die, the projected portion being inserted into the hole portion of the work.

9. Dies for forging a gear-shaped part made of a sheet metal according to claim 8, wherein the projected portion has such an outside diameter as to define a gap in the radial direction between the projected portion and the peripheral edge of the hole portion of the work in the unworked state.

* * * * *

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

On the Cover Page, in the title:
Change "DIES" to --DIE ASSEMBLY--.

On the Cover Page, in the Abstract:
Line 1 thereof, change "Disclosed herein in dies" to --A die assembly--;
Line 2, change ", comprising" to --includes--;
Line 6, change ", wherein ridges" to --. Ridges--;
Line 18, change "inner to" to --the inner side to the-- and delete "irra-";
Line 19, change "tional" to --excessive--;
Line 22, change "contrive" to --design--;
Line 24, change "contrived" to --achieved--;
Line 25, change "the like" to --related elements--;
Line 26, change "irrational" to --excessive-- and change "the" to --such--.

Column 1, line 1 (the title), change "DIES" to --DIE ASSEMBLY--;
line 7, after "in" insert --a--;
line 8, change "dies" to --die assembly--;
line 38, change "press working" to --a press working operation--.

UNITED STATES PATENT AND TRADEMARK OFFICE
CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 2, line 18, change "at" to --during--;
line 19, change "stroke" to --single stroke of the forging operation--;
line 24, change "leading" to --resulting in--;
line 25, after "by l" insert --a distance ℓ--;
line 36, change "The" to --This--;
line 42, change "the" (second occurrence) to --this--;
line 44, delete "the" (first occurrence);
line 45, change "The" to --This--;
line 49, change "each" to --for each part--;
line 50, change "the" to --this--;
line 58, change "dies" to --a die assembly--;
line 61, change "resides in dies" to --provides a die assembly--.

Column 3, line 11, change "inner to" to --an inner side to an--;
line 12, change "irrational" to --excessive--;
line 15, change "contrive" to --design--;
line 16, change "dies" to --die of the invention--;
line 17, change "contrived" to --achieved--;
line 18, change "the like" to --related elements--;
line 19, change "irrational" to --excessive--;
line 20, change "the" to --such--;
line 38, delete "portion";
line 40, change "comprise" to --include--;
line 43, delete "portion";

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 3, line 49, delete "portion" (first occurrence);
line 52, delete "portion";
line 64, change "shows" to --is--;
line 66, change "shows" to --is--.

Column 4, line 1, change "shows" to --is--;
line 2, after "of" insert --a--;
line 3, change "shows" to --is--;
line 5, change "shows" to --is--;
line 7, change "shows" to --is--;
line 9, change "shows" to --is--;
line 10, delete "the" (second occurrence);
line 12, change "shows" to --is-- and after "of" insert --a--;
line 16, change "the" (both occurrences) to --a--;
line 18, change "shows" to --is--;
line 22, change "shows" to --is--;
line 23, change "shows" to --is--;
line 24, change "the" (first occurrence) to --a--;
line 25, change "shows" to --is--;
line 26, change "the" to --a--;
line 27, change "shows" to --is--;
line 29, change "shows" to --is--;
line 31, change "shows" to --is--;
line 34, change "shows" to --is--;
line 38, change "shows" to --is--;
line 55, change "with" to --as--;
line 58, change "the" to --such--.

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 5, line 38, change "the" to --a--;
line 50, after "uously," insert --extending--;
line 52, after "1" insert --(FIG. 17)--;
line 63, after "with" insert --at least--;
line 64, delete "at least".

Column 6, line 20, change "wavy" to --wave--;
line 52, change "based on" to --with reference to--.

Column 7, line 1, delete "a";
line 4, after "40" insert --is--;
line 13, after "seizure" insert --of the work--;
line 33, change "inner to" to --the inner side to the-- and after "irrational" insert --or excessive--;
line 34, change "the like" to --related elements--;
line 40, change "the like" to --related elements--;
line 45, after "join," insert --thus--;
line 47, after "value," insert --and--;
line 57, delete "portion" (first occurrence);
line 60, change "portion" to --is provided--;
line 61, delete "is provided";
line 63, after "diameter," insert --and-- and delete "portion";
line 64, before "mechanical" insert --a-- and after "working" insert --operation--;
line 66, after "instance" insert --as--;

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 7, line 67, change "the" (first occurrence) to --a-- and delete "between".

Column 8, line 3, delete "the";
line 6, after "but" insert --also--;
line 7, change "the" (second occurrence) to --such--;
line 8, delete "portion";
line 12, delete "between";
line 19, delete "be-";
line 20, delete "tween";
line 27, delete "portion";
line 29, change "6 formed with the" to --6.--;
line 30, delete entirely;
line 31, delete entirely;
line 38, delete "portion";
line 39, change "is made" to --may be formed--;
line 41, delete "portion";
line 50, delete "between";
line 53, change "that" to --such corner--;
line 54, delete "portion";
line 58, delete "portion";
line 61, delete "portion";
line 63, delete "portion";
line 64, delete "portion";
line 65, after "squeezing" insert --operation--.

Column 9, line 1, change "squeezing" to --the squeezing operation--;

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 9, line 6, delete "between";
line 8, after "squeezing" insert --operation--;
line 9, change "19 in terms of enlarged" to --19,--;
line 10, delete "section,";
line 15, delete "por-";
line 16, delete "tion";
line 18, after "to" insert --the shape of--;
line 25, after "to" insert --form or--;
line 53, delete "between";
line 57, delete "por-";
line 58, delete "tion";
line 62, delete "portion";
line 66, delete "portion";
line 67, delete "portion".

Column 10, line 1, delete "portion", after "by" insert --a-- and after "working" insert --operation--;
line 2, after "squeezing" insert --operation--;
line 11, delete "portion";
line 14, delete "between";
line 19, delete "portion" (first occurrence);
line 26, delete "portion";
line 33, delete "portion";
line 35, change "squeezing" to --the squeezing operation--;
line 36, delete "portion";
line 43, delete "portion";
line 45, change "the" (second occurrence) to --such-- and change "diameter" to --diameters,--;

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 10, line 46, delete "portions,";
line 48, delete "between";
line 53, delete "portion" and change "squeezing" to --the squeezing operation--;
line 55, after "as" insert --discussed--;
line 66, change "the" (second occurrence) to --such--.

Column 11, line 4, change "Dies" to --A die assembly--;
line 10, change "the" (first occurrence) to --said--;
line 11, change "of the die" to --thereof--;
line 13, change "the" to --said--;
line 14, change "of the die" to --thereof-- and change "the" (fourth occurrence) to --said--;
line 16, change "the" to --said--;
line 17, change "the" (second occurrence) to --said--;
line 19, change "Dies" to --A die assembly--;
line 20, change "the" to --said--;
line 21, after "with" insert --at least-- and delete "at least--;
line 22, change "the" (second occurrence) to --said--;
line 23, change "the" to --said-- and change "surfaces" to --surface--;
line 24, change "the" (second and third occurrences) to --said--;
line 25, change "the" (first occurrence) to --a--;

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 11, line 27, change "Dies" to --A die assembly--;
line 28, change "the grooves are" to --each of said grooves is--;
line 30, change "grooves respectively" to --respective groove--;
line 31, change "Dies" to --A die assembly--;
line 32, change "the" to --said--;
line 34, change "the" to --said--.

Column 12, line 1, change "the" (second occurrence) to --said--;
line 2, change "the" to --said--;
line 4, change "Dies" to --A die assembly--;
line 5, change "the" (second occurrence) to --said--;
line 6, change "the" (first occurrence) to --said--;
line 7, change "the" (second occurrence) to --said--;
line 10, change "Dies" to --A die assembly--;
line 12, delete "portion";
line 13, change "the" to --said--;
line 14, change "the" to --said--;
line 17, delete "portion";
line 18, change "Dies" to --A die assembly--;
line 19, change "the" to --said--;
line 21, change "the" (both occurrences) to --the--;
line 23, change "Dies" to --A die assembly--;
line 24, change "the" to --said--;

UNITED STATES PATENT AND TRADEMARK OFFICE

CERTIFICATE OF CORRECTION

PATENT NO. : 4,876,876

DATED : October 31, 1989

INVENTOR(S) : Kyoso ISHIDA et al.

It is certified that error appears in the above-identified patent and that said Letters Patent is hereby corrected as shown below:

Column 12, line 26, change "the" (all three occurrences) to --said--;
line 27, delete "portion" (second occurrence);
line 29, change "Dies" to --A die assembly--;
line 30, change "the" to --said--;
line 32, change "the" (second occurrence) to --said--;
line 33, delete "portion".

Signed and Sealed this

Third Day of December, 1991

*Attest:*

HARRY F. MANBECK, JR.

*Attesting Officer*

*Commissioner of Patents and Trademarks*